US006382934B2

(12) United States Patent
Budde

(10) Patent No.: US 6,382,934 B2
(45) Date of Patent: May 7, 2002

(54) REVERSING VALVE FOR A COMPRESSED AIR MEMBRANE PUMP

(75) Inventor: Dirk Budde, Kerken (DE)

(73) Assignee: ALMATEC Maschinenbau GmbH, Kamp-Lintfort (DE)

( * ) Notice: Subject to any disclaimer, the term of this patent is extended or adjusted under 35 U.S.C. 154(b) by 0 days.

(21) Appl. No.: 09/143,949

(22) Filed: Aug. 31, 1998

(30) Foreign Application Priority Data

Sep. 4, 1997 (DE) ..... 197 38 779

(51) Int. Cl.[7] ..... F04B 35/00; F01L 25/02; F01L 31/02; F01L 31/00; F03B 31/00

(52) U.S. Cl. ..... 417/395; 91/303; 91/286; 91/345; 91/350; 137/625.63

(58) Field of Search ..... 417/395, 394, 417/392; 91/303, 281, 286, 344, 345, 350, 352; 137/625.69, 625.63

(56) References Cited

U.S. PATENT DOCUMENTS

| | | | | | |
|---|---|---|---|---|---|
| 3,236,441 | A | * | 2/1966 | Russell | 230/54 |
| 3,652,187 | A | * | 3/1972 | Loeffler et al. | 417/393 |
| 3,958,903 | A | * | 5/1976 | Capelli | 417/437 |
| 4,406,596 | A | * | 9/1983 | Budde | 417/393 |
| 4,681,327 | A | * | 7/1987 | D'Agostino et al. | 277/29 |
| 4,830,586 | A | * | 5/1989 | Herter et al. | 417/395 |
| 5,222,876 | A | | 6/1993 | Budde | 417/393 |
| 5,391,060 | A | * | 2/1995 | Kozumplik, Jr. et al. | 417/393 |
| 5,538,042 | A | * | 7/1996 | Baland | 137/625.63 |

FOREIGN PATENT DOCUMENTS

| | | | |
|---|---|---|---|
| DE | 33 10 131 | 9/1984 | 43/6 |
| EP | 0 061 706 | 10/1982 | 43/6 |

OTHER PUBLICATIONS

Mark's Stander Handbook for Mechanical Engineers 10th Ed. p. 8–840, Jan. 1996.*

* cited by examiner

*Primary Examiner*—Charles G. Freay
*Assistant Examiner*—Timothy P. Solak
(74) *Attorney, Agent, or Firm*—Merchant & Gould, P.C.

(57) ABSTRACT

A reversing valve for a compressed air membrane pump in which an equilibrium state of the main piston in the neutral position, leading to stoppage of the pump, is prevented by disposing the main system piston and the pilot system piston immediately adjacent to one another.

16 Claims, 5 Drawing Sheets

REVERSING VALVE FOR A COMPRESSED AIR MEMBRANE PUMP

FIELD OF THE INVENTION

The invention relates to a reversing valve for a compressed air membrane pump in which the membranes are pressurised on alternate sides by means of a main control system which oscillates essentially between two positions and is controlled by a pilot system.

BACKGROUND AND PRIOR ART

Control means for compressed air membrane pumps generally comprise a main control system and a pilot control system. The main control system effects the alternate pressurisation of the membranes, while the pilot control system effects the reversal of the main control system in the end positions of the pump. Known pilot control systems include mechanical systems such as that described, for example, in European patent application 0 061 706 and magnetic systems such as that described in German Offenlegungsschrift 41 06 180.

Pumps with these kinds of control systems do not meet the high demands imposed for the transportation of very high purity acids, alkalis and solvents in the semiconductor industry, since pumps for this purpose require complete freedom from metal, which cannot be achieved with mechanically or magnetically controlled pumps. The high demands made on pumps used in the semiconductor industry arise from the fact that contamination of the pumping media by metal ions must be excluded at all costs, since, for example in the manufacture of a computer chip, even a few metal ions can be enough to ruin a whole batch. It follows that not only must those components of the pump which are in contact with the pumping media be metal-free, but also the components of the pump which do not come into contact with the media: nowadays a service life of 80 to 100 million cycles is expected for membrane pumps, and in operating the pump the possibility of a membrane rupture in which the pumping media could penetrate into the interior of the pump must be taken into account.

Hence for the fields of application described above the only membrane pumps which can be used are those of which the control systems operate pneumatically, since only such pumps can be made metal-free.

A pump with a control system of this kind is described in German patent specification 33 10 131. The reversing system described there comprises a pneumatically driven main valve control piston having a pilot piston system arranged inside the piston. Whenever the membrane pump reaches its end position, the pilot piston system is reversed by longitudinal displacement of the pilot piston by means of stop pins.

A general problem with known pneumatically operated control systems is that operation of the pump at low speed can lead to its coming to a standstill due to the reversing system assuming a neutral position. If the piston of the pilot system, driven by the movement of the membrane, reaches its neutral position, the pressurisation of the piston of the main system is interrupted. This is then no longer fixed in its end position. Since in order to supply driving air to the membranes the piston of the main system must be located in its end position, the pump comes to a standstill if, due to the neutral position of the pilot piston, the main system piston is no longer unilaterally pressurised and then, diverting the pressure from the main duct, likewise assumes a neutral position.

The reversing system known from German patent 33 10 131 accepts considerable technical complications in order to avoid the danger of a pump stoppage due to a neutral position of the control system. Nevertheless even with this system a pump stoppage cannot be ruled out in certain circumstances.

Thus if, for example, there is a sudden drop in pressure of the driving air the main piston can come to a standstill in its middle position and block the compressed air supply of the two membranes. Since the pilot piston is only moved during the last part of the path of the membranes or of the membrane piston, for the remaining time it is freely movable and can swing back from its end position and likewise assume a neutral position. In this state the pump is then completely blocked, since the neutral position of the main piston prevents any movement of the pump, while the neutral position of the pilot piston prevents the main piston from moving out of its neutral position. The tendency of the pilot piston to assume and remain in a neutral position is increased by the presence between the pilot system and the main control piston of a rigid sleeve which does not take part in the respective displacements of the pistons.

OBJECT OF THE INVENTION

The object of the invention is therefore to provide a reversing unit for pneumatically driven compressed air membrane pumps in which an equilibrium state of the main piston in the neutral position, leading to stoppage of the pump, is avoided.

SUMMARY OF THE INVENTION

The achievement of this object is based on the idea of constructing the reversing unit in such a way that an equilibrium position of the main piston or of the pilot piston in the neutral position is ruled out by having the pilot system and the main control system cooperate directly, i.e. so that a change in the position of the one piston directly changes the relative position of the other piston, so that the physical relationship of the two pistons is never adjusted independently of one another. The significance of this is that as a result a piston located in the neutral position will already be brought out of its neutral position again by the fact that the second piston is seeking to assume the neutral position.

Accordingly the invention provides a pneumatic reversing system for a pressure-driven membrane pump which pressurises the membranes on alternate sides with compressed air by means of a main control system which swings back and forth essentially between two positions and is controlled by a pilot system in which the pilot control system and the main control piston are disposed directly adjacent to one another.

In an embodiment of such a pneumatic reversing system the adjacent pilot control unit and the main control piston are each provided with ducts such that in each end position of the pilot control piston the main control piston is unilaterally pressurised with air in such a way that the main control piston is displaced into its respective opposite end position.

The object of the invention is also achieved if the pilot control function is taken over by a piston which is coupled with the membrane piston at least over the predominant part of the displacement path of the membrane piston.

This is preferably done by forming the membrane piston in such a way that in the course of its transverse displacement it effects a change in the compressed air pressurisation of the main system piston and thereby its abrupt displacement from one end position to the other.

As a result of the function of the pilot system being taken over by the membrane piston, i.e. by avoiding a separate pilot system which is only actuated during the last section of the path of the membrane and/or of the pilot system immediately adjoining the main control piston, an uncontrolled neutral positioning of the pilot system such as led in the prior art to stoppage of the pump, for example due to swinging back of the pilot piston or to a temporary drop in pressure, is ruled out. If one of the pistons is in its neutral position, then as soon as the second piston moves into its neutral position it is at once subjected to changed pressure relationships such that the first piston moves back again into its end position. In any case the direct coupling of the control pistons leads to the taking up of the neutral position by one piston bringing the other piston out of the neutral position.

The membrane piston in accordance with the invention is preferably formed in three regions with a waist. In a particular position of the membrane piston the waist or narrowed area of the piston, which otherwise fits in its guide in an air-tight manner, provides a connection between the various ducts in the main piston and the pump housing.

Thus in the end position of the membrane piston the compressed air is supplied through a control duct in the main control piston and through the waist in the membrane piston, which in this position is located directly below the duct opening of the main control piston, for example to an end face of the main control piston, so that the latter piston abruptly changes its final position and thus opens a compressed air duct to another membrane. In this position the control duct of the main control piston, which was previously in communication with the waist of the membrane piston, lies on the unnarrowed outer surface of the membrane piston, which prevents the compressed air from being passed on, until through the longitudinal displacement of the membrane piston the waist again forms a connection between the second end face of the main control piston and the pressurised control duct in the main control piston.

Further waists allow the air to flow away from the various chambers which are not pressurised, so that the pressurised chambers can be increased in size without resistance by displacement of the individual components.

As a result of the main system piston and pilot system piston not forming two components which are displaceable independently of the position of the membrane, but rather of a displacement of the main system piston also forcing a change in its position relative to the pilot system or to the membrane piston, the main system piston, when it is on the way to its neutral position in respect of membrane pressurisation, is at once brought back by the change in position relative to the membrane piston or to the pilot system into the stable end position in which the membrane pressurisation is not impaired. Stopping of the pump as a result of a neutral middle position of the main system piston is thus ruled out.

In just the same way swinging of the pilot system back into its neutral position from an end position is also ruled out, since it is necessarily coupled with the position of the membrane. The system in accordance with the invention thus provides a reversing unit which is free from dead points in all operating states.

BRIEF DESCRIPTION OF THE DRAWINGS

The invention is described in more detail below, by way of example, with reference to an embodiment shown in the drawings, in which.

DETAILED DESCRIPTION OF A PREFERRED EMBODIMENT OF THE INVENTION

Figure 1:
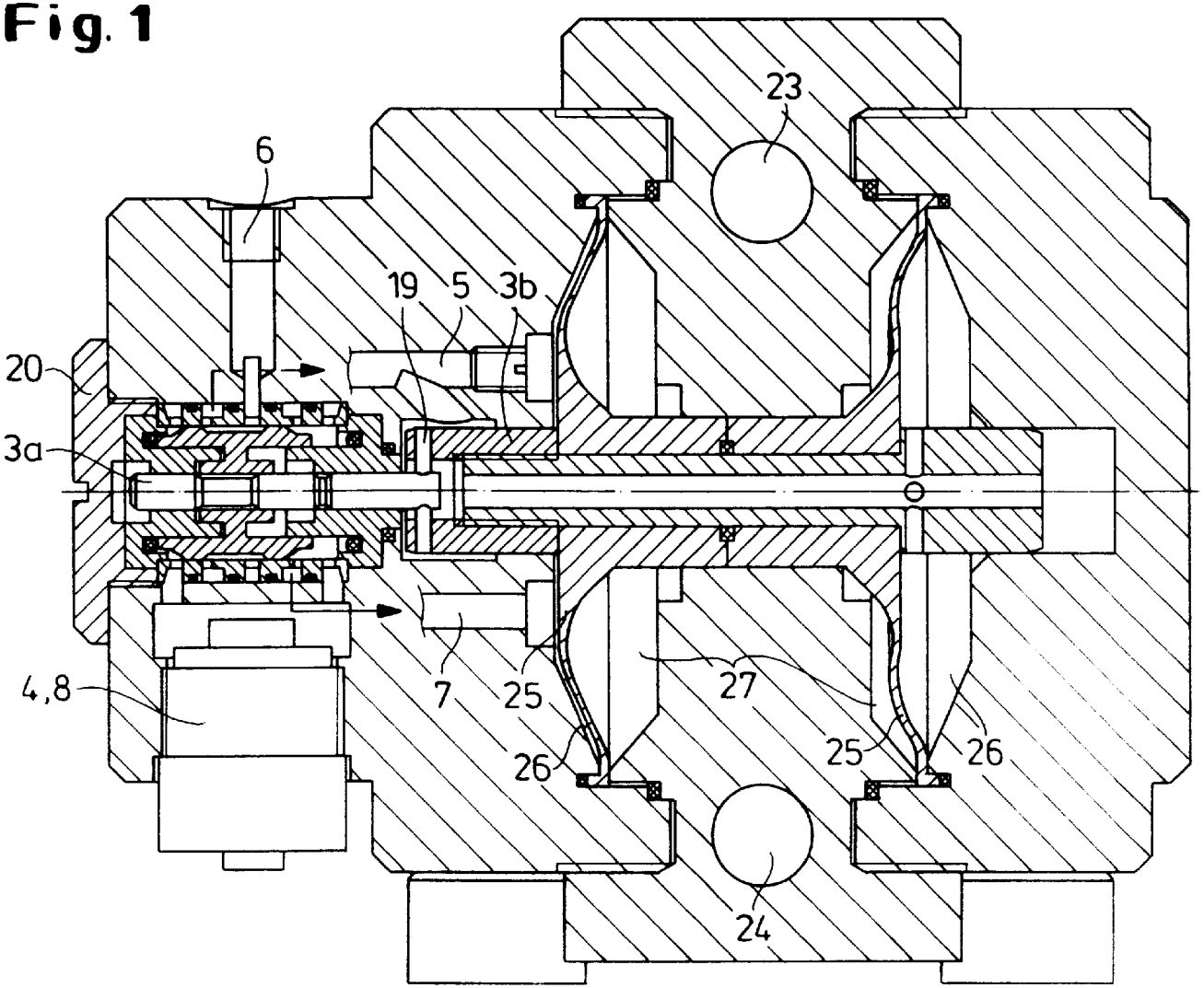
FIG. 1 is a section through a double membrane pump with the reversing system in accordance with the invention.

The reversing unit 1 comprises a main control piston 2, a membrane piston 3 and ducts 4, 5, 6, 7, 8. The main control piston 2 is longitudinally displaceable in a piston chamber which is divided by the main control piston into a pressure chamber 9 and an exhaust chamber 10 which, depending on its position of the piston, are to the left or right of the piston. The pressure chamber 9 prevents the main control piston from moving out of an end position, while the exhaust chamber 10 provides a connection between the air-filled membrane and the environment. As the main control piston 2 is longitudinally displaced, the pressure chamber 9 and the exhaust chamber 10 move from one end of the piston chamber to the opposite end. The main control piston has tongues 2*a* and 2*b* on either side. After the displacement of the main control piston the original exhaust chamber and the original pressure chamber Is are filled by the tongues. The tongues 2*a* and 2*b* also seal the exhaust chamber from the pressure chamber.

The membrane piston is located in a further piston chamber provided in the reversing unit and has waists 11, 12 and 13.

According to the position of the main control piston 2 the compressed air is supplied through the bore 6 to the bore 5 or to the bore 7 through the main duct 14, and thus to the respective membrane 15.

The main control piston 2 has a central duct 16 for the supply of the compressed air from the compressed air duct 6 to the pressure chamber 9 through the waist 12 in the membrane piston 3 when this assumes the corresponding position. The reversing unit also includes pressure chamber venting ducts 17, 18 for venting the pressure chamber 9 through the waists 11, 13. The ducts 17, 18 communicate with the exhaust chamber 10 and consequently with the venting ducts 4 and 8 respectively.

The course of the reversing process will now be described with reference to FIGS. 2 to 5.

Figure 2:
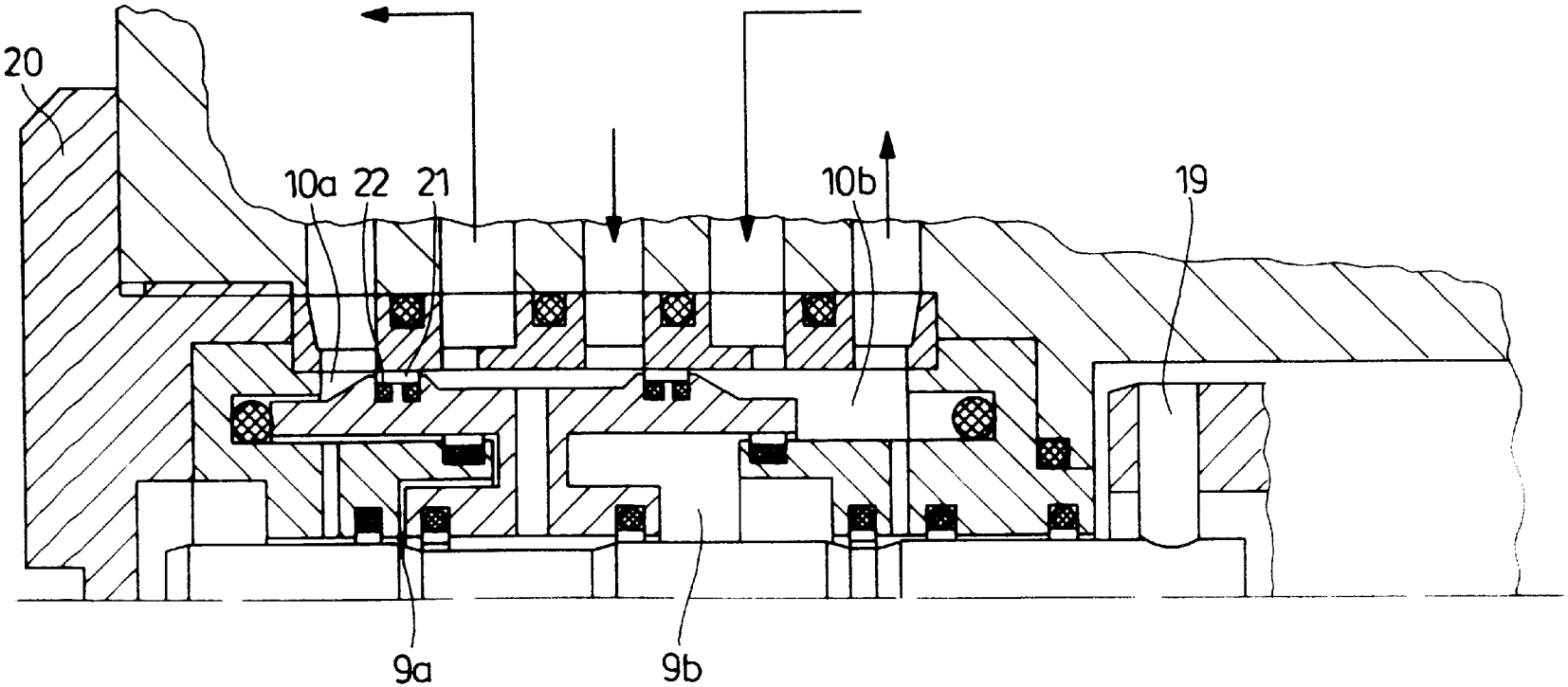
FIG. 2 is a section through part of the reversing system of FIG. 1 shortly before the change in position of the main system piston.

In FIG. 2 the main control piston 2 is shown in its left hand end position. In this position the pressure chamber 9*b* and the exhaust chamber 10*b* are formed on the right hand side of the main control piston 2 and are sealed from one another by the tongue 2*a* of the main control piston. When the main control piston 2 is in this position the compressed air supplied through the compressed air duct 6 flows through the duct 14 to the membrane duct 5 and into the air chamber 26, by means of which the membrane 25 is pressurised with compressed air. An increase in the size of the air chamber 26 leads to reduction in size of the pump chamber 27, thereby moving the pumping medium through the pressure side product duct 23. The opposite air chamber 26 thus becomes smaller, leading to an increase in size of the corresponding pump chamber 27 and to the medium being sucked in through the suction-side product duct 24. In the said position of the main control piston 2 the air can escape from the shrinking membrane air chamber 26 through the membrane duct 7, the exhaust chamber 10*b* and the venting duct 8. In the said end position of the membrane piston 3 there is also a connection from the compressed air duct 6 through the duct 14 and the central duct 16 to the waist 12 of the membrane piston 3. In this end position of the main control piston 2 the space remaining in the pressure chamber 9*a* is pressurised with compressed air through the waist 12. Consequently the situation shown in FIG. 2 is unstable and shows the main control piston just before its reversal or displacement into its other end position. As the main control piston 2 is displaced into its right hand end position the pressure chamber 9*a* is increased in size, while the volume of the pressure chamber 9*b* is decreased and the excess air is supplied to the venting duct 8 through the waist 11, the pressure chamber venting duct 18 and the exhaust chamber 10*b*. Thus both the air from the chamber 9*b* and that from the chamber 10*b* can escape through the venting duct 8 as the main control piston 2 is longitudinally displaced.

Figure 3:
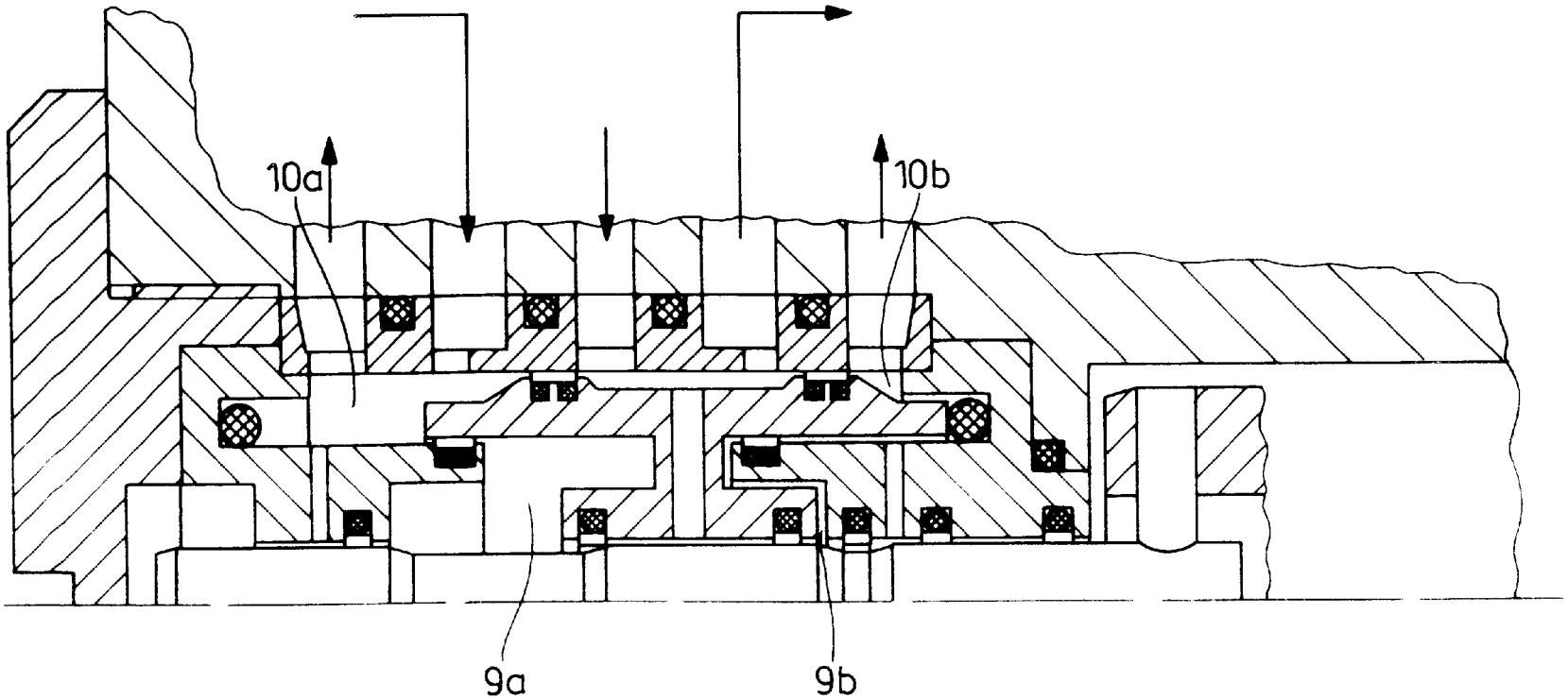
FIG. 3 shows the partial section of FIG. 2 after the change in position of the main control piston.

In FIG. 3 the main control piston 2 is shown in its right hand end position. The compressed air is now supplied from the compressed air duct 6 through the duct 14 to the membrane duct 7, while the exhaust air from the membrane duct 5 can escape through the exhaust chamber 10*a* and the venting duct 4. Since in this position the central duct 16 is blocked and the pressure chamber 9*a* has no connection to the duct 17, in the said position of the membrane piston 3 the end position of the main control piston 2 shown is stable.

Figure 4:
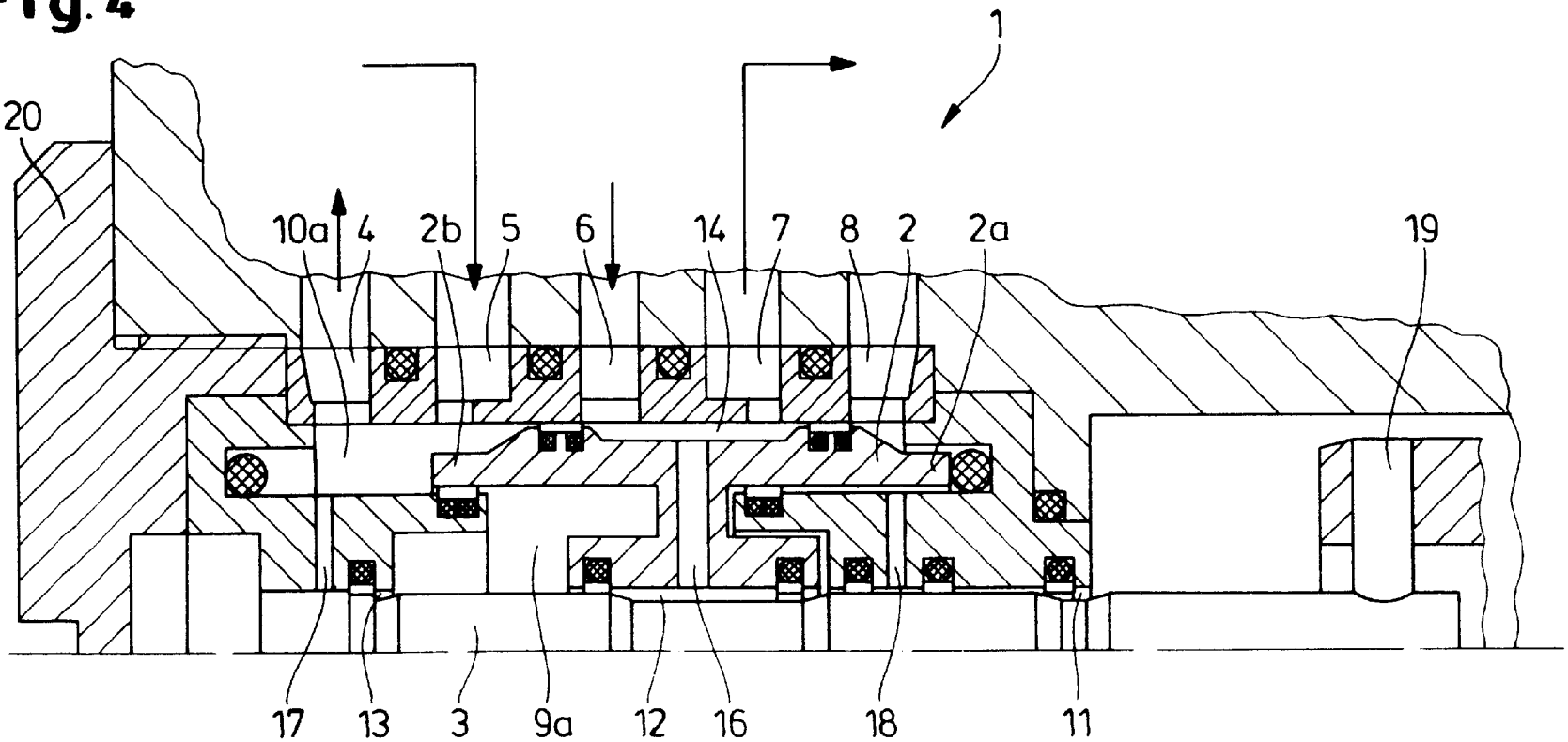
FIG. 4 shows the partial section of FIG. 2 after a longitudinal displacement of the membrane piston shortly before the renewed change in position of the main system piston.
Figure 5:
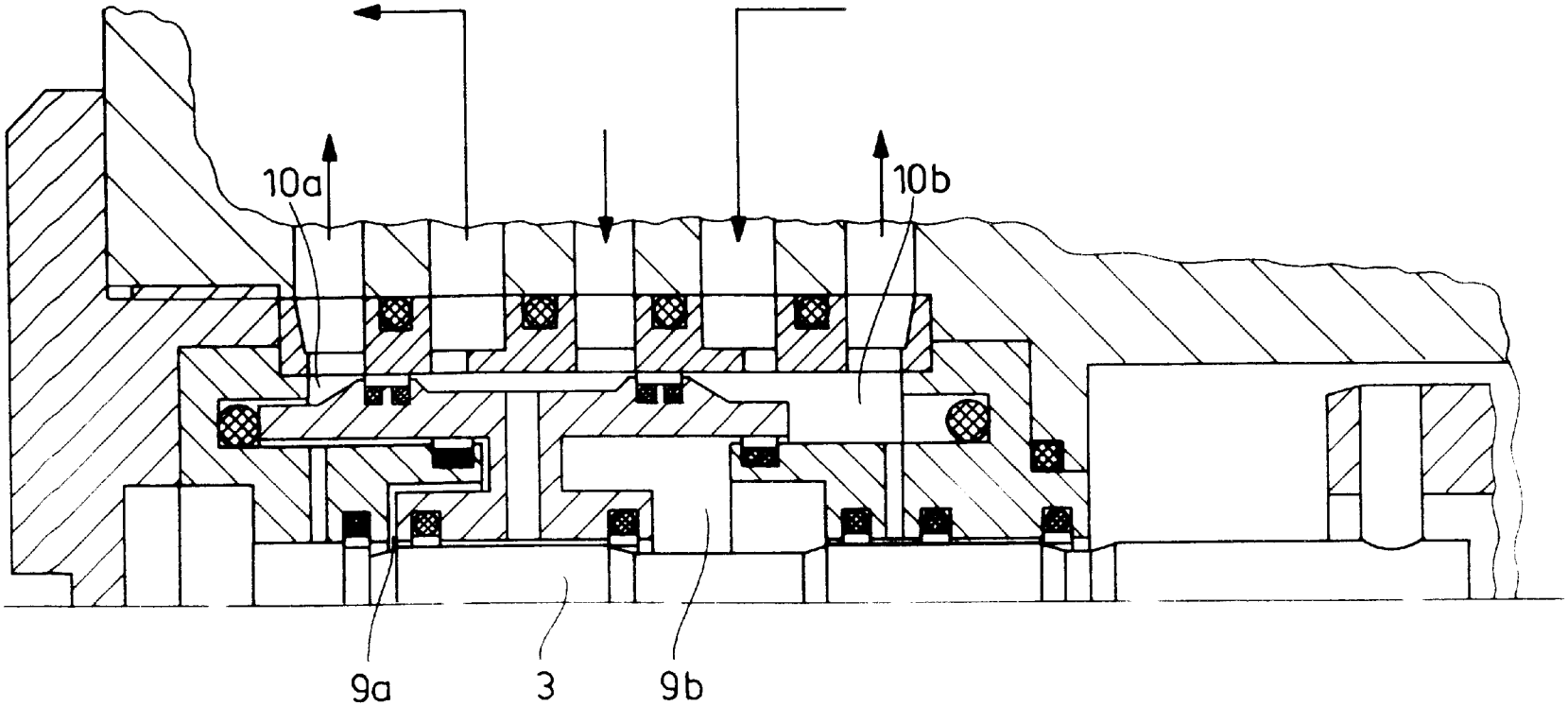
FIG. 5 shows the partial section of FIG. 2 after the second change in position of the main system piston.

FIGS. 4 and 5 show the main control piston just before and after its displacement from the right hand end position into the left hand end position corresponding to the sequence of events illustrated above. The point in time at which the reversal takes place can be adjusted by the size of the waists in the membrane piston 3.

Since the embodiment of the reversing unit in accordance with the invention which has been described is preferably used with hot, very high purity media, the membrane piston 3 is made in multipart form in order to interrupt the flow of heat, the part 3*a* of the piston which performs the pilot function being connected to the membrane side part 3*b* of the piston by a bolt 19.

The reversing unit is fitted in the pump in such a way that access from outside the pump is possible simply by unscrewing the screw cap 20 from the pump housing.

Both the reversing unit and also all the other components of the pump are made of various plastics materials and are as completely free from metal as is necessary to the transportation of very high purity media.

The individual components therefore frequently undergo large thermal expansions. The necessary fluid-tightness is ensured by the use of piston rings 21 with O-rings 22 underneath them. Both these rings again consist of plastics material.

In a metal-free pump the selection of suitable pairs of plastics material is of particular importance. The following pairs of materials are suitable in respect of their frictional and wear properties when the O-rings are compressed under the piston rings by from 5 to 12%, and preferably 7 to 10%.

Piston ring:

ultra-high-molecular weight low pressure polyethylene (PE UHMW (1000))

Running counterpart:

polyethylene terephthalate (PETP),
polybutylene terephthalate (PBTP)

or

Piston ring:

polytetrafluoroethylene with 15% polyphenylene sulfide (PTFE+15 PPS)

Running counterpart:

polyethylene terephthalate (PETP),
polybutylene terephthalate (PBTP),
polyarylether ether ketone (PEEK),
polyarylether ketone (PEK).

Particular importance attaches to the compression of the O-rings in respect of obtaining the smallest possible friction at the same time as fluid tightness. It is known to use O-rings with a compression of 25%. According to the invention the rings of the plastics material pumps are compressed by 5–12%, preferably 7–10%, which gives an optimum combination of fluid tightness and low friction in the given circumstances.

The use of fluorothermoplastics offers the advantage of providing resistance to the majority of aggressive pumping media.

What is claimed is:

1. A pneumatic reversing system suitable for use in a pressure-driven membrane pump having membranes on either side of the pump, the reversing system comprising:

a membrane piston displaceable essentially between two positions;

a main control piston displaceable essentially between two positions, said main control piston is in pneumatic cooperation with said membrane piston; and means for urging the main control piston towards one of said two positions at all points in an operating cycle of said pump;

wherein said reversing pump alternately provides compressed air to the membranes on either side of the pump; and wherein said membrane piston and said main control piston are directly coupled such that a displacement of one of the membrane piston and the main piston causes a displacement of the other, and wherein the main control piston is urged towards one of its two positions at all points in an operating cycle of said pump.

2. A reversing system as claimed in claim 1, wherein the membrane piston comprises waists, whereby said waists selectively convey compressed air to displace the main control piston, according to the position of the membrane piston and the main control piston.

3. A reversing system as claimed in claim 2, wherein the main control piston comprises a central duct, whereby said central duct selectively conveys compressed air to displace the main control piston according to the position of the membrane piston and the main control piston.

4. A reversing system as claimed in claim 1, wherein the main control piston comprises a central duct, whereby said central duct selectively conveys compressed air to displace the main control piston according to the position of the membrane piston and the main control piston.

5. A reversing system as claimed in claim 1, wherein the main control piston further comprises piston rings and O-rings, and wherein the piston ring is composed of ultra-high-molecular weight low pressure polyethylene (PE UHMW (1000)), and the O-rings are composed of a material selected from the group consisting of polyethylene terephthalate (PETP) and polybutylene terephthalate (PBTP).

6. A reversing system as claimed as claimed in claim 5, wherein the O-rings exhibit a compression of 5–12%.

7. A reversing system as claimed in claim 1, wherein the main control piston further comprises piston rings and O-rings, and wherein the piston ring is composed of polytetrafluoroethylene with 15% polyphenylene sulfide (PTFE+15 PPS), and the O-rings are composed of a material selected from the group consisting of polyethylene terephthalate (PETP), polybutylene terephthalate (PBTP), polyarylether ether ketone (PEEK), and polyarylether ketone (PEK).

8. A reversing system as claimed in claim 7, wherein the O-rings exhibit a compression of 5–12%.

9. A pneumatic reversing system suitable for use in a pressure driven membrane pump having membranes on either side of the pump, the reversing system comprising:

a membrane piston displaceable essentially between two positions, said membrane being suitable for coupling with the membranes on either side of the pump;

a main control piston displaceable between essentially two positions, said main control piston is in pneumatic cooperation with said membrane piston; and means for urging the main control piston towards one of said two positions at all points in an operating cycle of said pump;

wherein said reversing pump alternately provides compressed air to the membranes on either side of the pump; and wherein said membrane piston and said main control piston are pneumatically directly coupled such that a displacement of one of the membrane piston and the main control piston causes a displacement of the other via pneumatic means, and wherein the main control piston is urged towards one of its two positions at all points in an operating cycle of said pump via pneumatic means.

10. A reversing system as claimed in claim 9, wherein the membrane piston comprises waists, whereby said waists selectively convey compressed air to displace the main control piston, according to the position of the membrane piston and of the main control piston.

11. A reversing system as claimed in claim 10, wherein the main control piston comprises a central duct, whereby said central duct selectively conveys compressed air to displace the main control piston according to the position of the membrane piston and the main control piston.

12. A reversing system as claimed in claim 9, wherein the main control piston comprises a central duct, whereby said central duct selectively conveys compressed air to displace the main control piston according to the position of the membrane piston and the main control piston.

13. A reversing system as claimed in claim 9, wherein the main control piston further comprises piston rings and O-rings, and wherein the piston ring is composed of ultra-high-molecular weight low pressure polyethylene (PE UHMW) (1000)), and the O-rings are composed of a material selected from the group consisting of polyethylene terephthalate (PETP) and polybutylene terephthalate (PBTP).

14. A reversing system as claimed in claim 13, wherein the O-rings exhibit a compression of 5–12%.

15. A reversing system as claimed in claim 9, wherein the main control piston further comprises piston rings and O-rings, and wherein the piston ring is composed of polytetrafluoroethylene with 15% polyphenylene sulfide (PTFE+15 PPS), and the O-rings are composed of a material selected from the group consisting of polyethylene terephthalate (PETP), polybutylene terephthalate (PBTP), polyarylether ether ketone (PEEK), polyarylether ketone (PEK).

16. A reversing system as claimed in claim 15, wherein the O-rings exhibit a compression of 5–12%.

* * * * *